United States Patent [19]

Keenan

[11] Patent Number: 4,947,987

[45] Date of Patent: Aug. 14, 1990

[54] READY ACCESS HANG-UP STORAGE AND RETRIEVAL DEVICE FOR ARTICLES OF WEAR

[76] Inventor: Kathleen C. Keenan, 6644 S. Kolin, Chicago, Ill. 60629

[21] Appl. No.: 383,638

[22] Filed: Jul. 24, 1989

[51] Int. Cl.[5] ..... A45C 3/12; A45C 13/00; B65D 33/14; B65D 35/22

[52] U.S. Cl. ..... 206/292; 206/278; 383/23; 383/39; 383/40

[58] Field of Search ..... 206/278, 287, 292; 383/38, 39, 23, 40; 211/34; 196/107, 109

[56] References Cited

U.S. PATENT DOCUMENTS

| | | | |
|---|---|---|---|
| D. 197,146 | 12/1963 | Fisher | 383/39 X |
| 1,495,220 | 5/1924 | Carroll | 383/39 |
| 1,579,023 | 3/1926 | Myers | 383/39 X |
| 1,591,538 | 7/1926 | Lenzikow | 206/287 |
| 1,652,269 | 12/1927 | Bremner | 206/287 |
| 1,847,066 | 3/1932 | Berg | 383/38 X |
| 2,423,297 | 7/1947 | Creamer . | |
| 2,832,389 | 4/1958 | Smith | 383/39 X |
| 2,974,780 | 3/1981 | Donovan | 206/278 |
| 3,039,599 | 6/1962 | Mintz | 206/287 |
| 3,115,959 | 12/1963 | Jaffe . | |
| 3,139,133 | 6/1964 | Spector . | |
| 3,294,134 | 12/1966 | Matross et al. | 383/39 |
| 3,330,321 | 7/1967 | Wels | 206/278 X |
| 3,448,839 | 6/1969 | Lugash . | |
| 3,542,170 | 11/1970 | Bialo | 190/41 |
| 3,669,276 | 6/1972 | Woods | 211/34 |
| 3,704,778 | 12/1972 | Raschdorf | 206/7 |
| 3,952,847 | 4/1976 | Via | 206/287 X |
| 4,580,667 | 4/1986 | Herwood | 383/39 X |

*Primary Examiner*—Sue A. Weaver

*Attorney, Agent, or Firm*—Hill, Van Santen, Steadman & Simpson

[57] ABSTRACT

A storage and retrieval device for articles of wear, such as sweaters, skirts, shorts, hosiery, shoes and the like, which are difficult, or impossible, to hang on a conventional hanger, comprises a suspension panel having opposite faces, a support for mounting the panel vertically from a clothes hanger bar in a closet or the like, and a plurality of overlapping flexible, depending loops mounted on the panel and opening sidewardly for receiving articles to be stored and from which the articles can be readily retrieved. A dust cover is provided for the device.

19 Claims, 1 Drawing Sheet

READY ACCESS HANG-UP STORAGE AND RETRIEVAL DEVICE FOR ARTICLES OF WEAR

BACKGROUND OF THE INVENTION

This invention relates to hang-up storage devices and is more particularly concerned with such devices especially useful for articles of wear.

Numerous and sundry articles of wear, such as sweaters, skirts, shorts, hosiery, shoes, and the like, are difficult to hang up on clothes hangers. For example, sweaters because of their generally flimsy nature are difficult to be supported on conventional clothes hangers because of a tendency of the sweaters to slip off. Other articles of wear, including those just mentioned above, are virtually, or altogether, impossible to be supported on a clothes hanger, and therefore have been conventionally disposed in flat storage or pocketed storage devices. There have been proposed vertical storage devices with sidewardly opening recesses between spaced vertical panels, but of limited capacity.

SUMMARY OF THE PRESENT INVENTION

A principal object of the present invention is to provide a new and improved ready access hang-up storage and retrieval device for articles of wear, providing especially convenient, and where desired large volume, storage capacity for articles in compact closet space.

Another object of the invention is to provide a new and improved device of the character described, which provides for large capacity article storage on a single vertical panel.

There is provided by the present invention a ready access hang-up storage and retrieval device for articles of wear, such as sweaters, skirts, shorts, hosiery, shoes, and the like, which are difficult, or impossible to hang on a conventional hanger, comprising a suspension panel; means for suspending the panel vertically; and a plurality of overlapping flexibly expansible, depending loops mounted on the panel and opening sidewardly for receiving articles to be stored and from which the articles can be readily retrieved.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
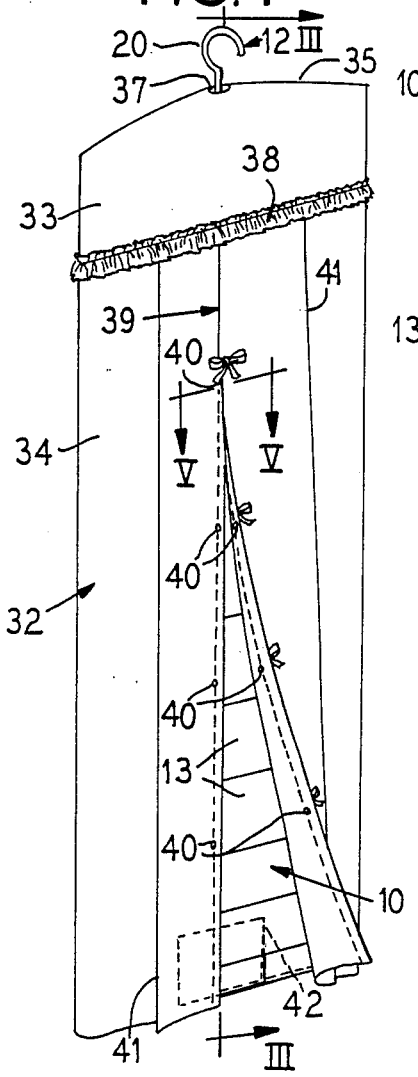
FIG. 1 is a perspective view of the device within a dust cover.
Figure 2:
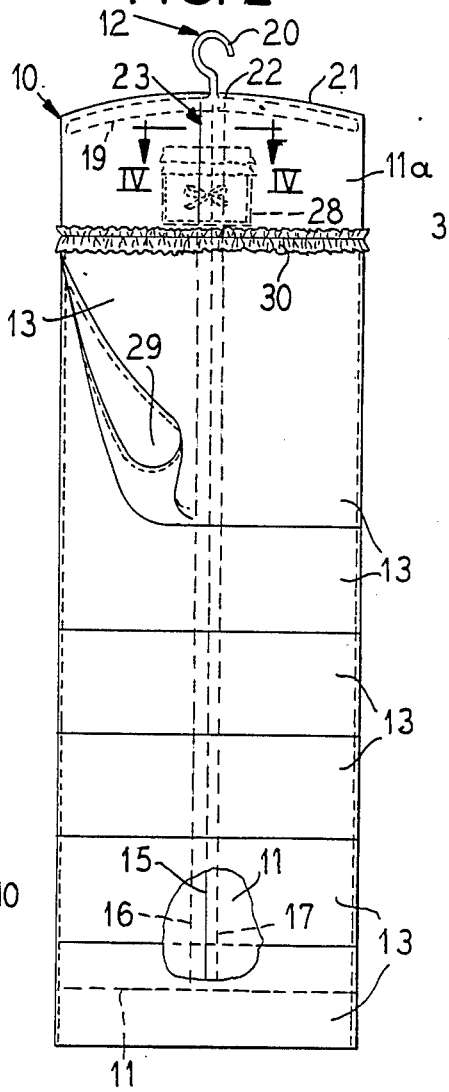
FIG. 2 is an elevational view of one face of the device outside of the dust cover.
Figure 3:
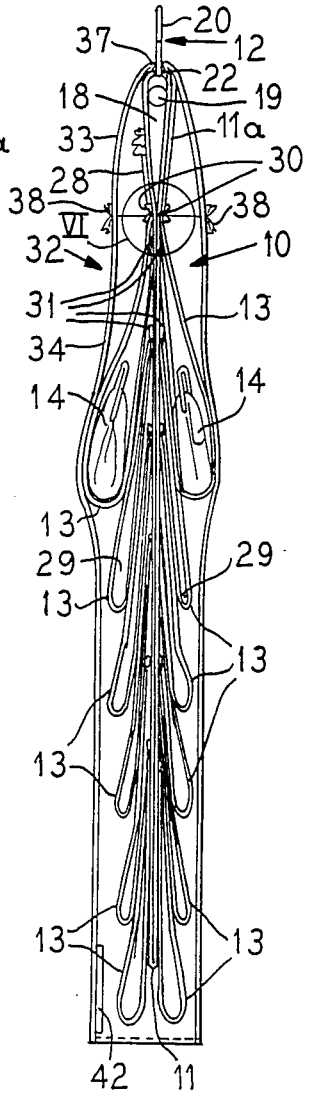
FIG. 3 is a vertical sectional detail view taken substantially along the line III—III in FIG. 1.

As shown in FIGS. 1–3, a device !0 embodying the present invention comprises as major components a suspension panel 11, means such as a hanger 12 for supporting the panel 11 vertically, and a plurality of overlapping, flexibly expansible depending loops 13 mounted on the panel and opening sidewardly for receiving articles 14 to be stored and retrieved.

In a preferred construction, the device 10 is made from a washable fabric material, and the panel 11 comprises a double walled structure conveniently formed as a flattened elongate tube of the material and of predetermined substantial width having opposite folded side edges and a central front seam 15 joining the margins of the material and with narrow respective oppositely underturned edge portions 16 and 17 of the material along the inside of the seam.

For accommodating the hanger 12, the upper end of the panel 11 has a hollow panel head structure **11*a* providing receiving space 18 therein within which a horizontal arched, supporting bar 19 of the hanger 12 is received with an upstanding central hook 20 of the hanger being adapted to engage a hanger rod in a clothes closet. A seam along the upper extremity of the panel 11 provides a shoulder 21 of generally arched form complementary to the hanger bar 19 for engaging upon the hanger bar. A central clearance hole 22 is provided in the shoulder 21 for upward extension therethrough of the shank of the hanger hook 20**.

Figure 4:
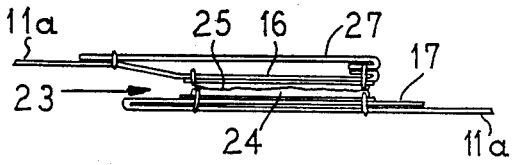
FIG. 4 is a fragmentary sectional detail view taken substantially along the line IV—IV of FIG. 2.

For assembling the hanger 12 in, or removing it from, the panel head space 18, a vertical access opening 23 is provided in the front wall of the panel head **11*a* as an upward extension of the panel seam 15. A neat reclosable closure for the access opening 23 may be provided by any suitable means for the purpose, such as a Velcro fastener of which one multi-hook strip 24 is carried by the underturned edge portion 17 (FIG. 4) while a complementary multi-hook strip 25 is attached to an upper portion of the edge portion 16 which straightened out and underlaps the edge portion 17 along the opening 23. A reinforcing strip 27 is desirably secured along the straightened edge portion 16. Through this arrangement, the fastener 24, 25 neatly holds the access opening 23 closed after the hanger 12 has been maneuvered through the opening 23 and installed within the space 18**.

A convenient small article receiving upwardly opening pocket 28 is desirably mounted on the back wall of the head **11*a***.

Figure 6:
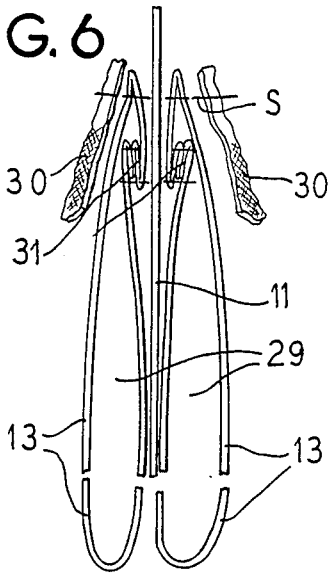
FIG. 6 is an enlarged fragmentary schematic illustrative exploded view taken substantially in the area VI in FIG. 3.

Along at least one face of the panel 11, and preferably along both faces, the loops 13 are arranged symmetrically and with the set of loops on each face of the panel 11 in paired alignment with the set of loops on the other face of the panel. Each of the loops 13 has a receiving opening 29 at each opposite side to facilitate article storage and retrieval. For large storage capacity, where the panel 11 is of an overall length of about 3½ feet and a width of about seventeen inches, there may be six of the loops 13, each about seventeen inches wide and fourteen inches long. At their upper ends the loops 13 in each set are secured to the panel 11 in such a manner that each underlapped loop 13 projects about five inches below the overlapping loop 13. In the arrangement shown, the uppermost paired loops 13 are secured as by means of common stitching S (FIG. 6) to the panel 11 along the lower edge of the panel head **11*a*. An attractive lace trim 30 may be secured as by stitching along and in concealing relation to the upper ends of the uppermost loops 13. Each succeeding aligned pair of the loops 13 downwardly from the uppermost pair of loops is secured as by means of common stitching to the panel 11** similarly as the uppermost loops.

Each of the loops 13 is desirably of a similar construction, being made from one piece of fabric which may be the same as the fabric of the panel 11. The free ends of each of the loops 13 are doubled upon themselves and secured together at the upper back portion of the loop into a reinforced seam 31 (FIGS. 3 and 6) adjacently below the stitched attachment of each loop to the panel 11.

Each of the loops 13 is desirably of an expanded capacity to receive at least one large article of wear 14 and may support a plurality of articles, if desired.

A removable dust cover 32 is provided of complementary form to cover the device neatly full length. In a preferred construction, the dust cover 32 comprises two major parts, namely a head part 33, generally complementary to the panel head 11*a*, and a longer skirt part 34 which covers the remainder of the device 10. Both of the parts 33 and 34 are preferably made from washable fabric of similar kind as the panel 11 and the loops 13. The part 33 has a shoulder seam 35 arcuately complementary to the shoulder 21 of the device 10. A central clearance hole 37 in the shoulder 35 provides clearance for the stem of the hanger hook 20. In a preferred construction, the head part 33 is formed up from two identical complementary wall panels of the material seamed together at the opposite sides and the top of the head part.

Figure 5:
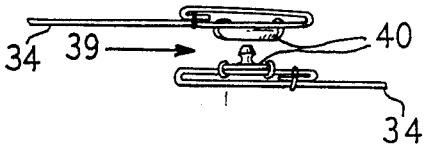
FIG. 5 is a fragmentary sectional detail view taken substantially along the line V—V in FIG. 1.

The skirt part 34 is desirably formed up from a tube of the material with the upper end of the tube secured as by stitching to the lower edges of the wall panels of the head part 33 and the connecting seam neatly covered ornamentally as by means of lace 38. The opposite margins of the skirt loop material are joined separably, which may be at either side of the cover 32, but is shown as preferably along a vertical central access opening 39 in the front wall of the skirt 34 by a vertically spaced series of separable fastener means, such as snaps 40 (FIGS. 1 and 5). With the dust cover 32 in place on the device 10, as shown in FIGS. 1 and 3, the device will be thoroughly protected against dust. When it is desired to load or unload any of the pockets 13, the opening 39 of the dust cover 32 can be easily opened and access gained to any pocket desired, whereafter the cover can again be closed by reclosing the fasteners 40.

Desirably, both the front and rear walls of the skirt 34 may be attractively vertically pleated as shown at 41.

Further, the rear panel of the dust cover skirt 34 may be provided on its inside lower portion with an upwardly opening pocket 42 for receiving insect repellent where the articles of wear or any of them may be of the kind that may be attacked by insects, such as moths.

It will be understood that variations and modifications may be effected without departing from the spirit and scope of the novel concepts of the present invention.

I claim:

1. A storage and retrieval device for articles of wear, such as sweaters, skirts, shorts, hosiery, shoes and the like, which are difficult, or impossible, to hang on a conventional hanger, comprising:

a suspension panel having opposite faces;

means for supporting said panel vertically;

a plurality of overlapping flexibly expansible, depending loops mounted on said panel and each loop end and each loop opening sidewardly for receiving articles to be stored and from which the articles can be readily retrieved;

each of said loops comprising a piece of flexible material having opposite ends located adjacent to one another at the top end of the loop;

means securing said opposite ends of each loop to said suspension panel; and wherein the secured upper ends of each overlapped loop are located substantially above the lower end of the overlapping loop.

2. A device according to claim 1, wherein said supporting means comprises a clothes hanger, and said panel comprises a double walled structure having upper ends of the walls connected and providing a head structure space with a shoulder at the connected wall upper ends for supporting the panel on said hanger.

3. A device according to claim 2, wherein one of said wall ends of said head structure has an access opening therein to facilitate assembling said hanger within said space.

4. A device according to claim 1, wherein said loops comprise a set of successive overlapping loops on each opposite face of said panel, with the loops in each set in paired alignment with the loops in the other set and said securing means being common to said loop sets.

5. A device according to claim 4, wherein the uppermost loop in each set is secured to the panel along the bottom of said head structure.

6. A device according to claim 5, wherein an ornamental strip conceals upper ends of said upper loops.

7. A device according to claim 4, wherein the loops in each set below the uppermost loops project partially below the immediately adjacent overlapping loop in each instance.

8. A device according to claim 3, wherein said panel comprises a flattened tube having margins joined along a vertical seam along the front face of the panel, the upper end of said seam providing said access opening.

9. A device according to claim 8, including a reclosable closure means for said access opening.

10. A device according to claim 1, including a dust cover enclosing the device.

11. A device according to claim 1, wherein the upper portion of said panel has an upwardly opening article receiving pocket.

12. A storage and retrieval device for articles of wear, which are difficult, or impossible, to hang on a conventional hanger, comprising:

a suspension panel having an upper end portion with an upwardly facing shoulder;

means associated with said shoulder for supporting said panel vertically;

a plurality of overlapping flexible, depending loops mounted on said panel and opening sidewardly for article storage and retrieval; and a removable generally tubular washable fabric dust cover complementary to and enclosing said device and having an upper end with a shoulder complementary to and supported on said upwardly facing shoulder, and said cover having an access opening vertically therealong, and means for reclosably fastening said opening.

13. A device with a dust cover according to claim 12, wherein said dust cover comprises a head part having said complementary shoulder and a tubular skirt part attached to and depending from said head part.

14. A device with a dust cover according to claim 13, wherein said access opening is located along a front wall of said dust cover.

15. A device and dust cover according to claim 12, wherein said dust cover has vertical pleats.

16. A device and dust cover according to claim 12, including a pocket on the inside lower portion of said dust cover for receiving insect repellent or the like.

17. A device and dust cover according to claim 12, wherein said device has an article receiving upwardly opening pocket on its top portion, and said dust cover has an upwardly opening pocket on its lower portion for receiving insect repellent or the like.

18. A storage and retrieval device for articles of wear, such as sweaters, skirts, shorts, hosiery, shoes and the like, which are difficult, or impossible, to hang on a conventional hanger, comprising:

a suspension panel having opposite faces;

means for supporting said panel vertically;

a plurality of overlapping flexibly expansible, depending loops mounted on said panel and opening sidewardly for receiving articles to be stored and from which the articles can be readily retrieved;

said supporting means comprises a clothes hanger, and said panel having a head structure for removably supporting the panel on said hanger;

said head structure providing a space at the upper end of said panel and a shoulder within said space for engagement on said clothes hanger, and said space being defined by a wall of said head structure having an access opening therein to facilitate assembling said hanger within said space; and said panel comprising a flattened tube having margins joined along a vertical seam along a front face of the panel, the upper end of said seam providing said access opening.

19. A device according to claim 18, including a reclosable closure means for said access opening.

* * * * *

UNITED STATES PATENT AND TRADEMARK OFFICE

CERTIFICATE OF CORRECTION

PATENT NO. : 4,947,987

DATED : August 14, 1990

INVENTOR(S) : Kathleen C. Keenan

It is certified that error appears in the above-identified patent and that said Letters Patent is hereby corrected as shown below:

Column 1, line 66, "!0" should read --10--.

Column 3, between lines 67 and 68, insert the following missing line
--in its depending condition having an upper end and a lower--.

Signed and Sealed this

Third Day of March, 1992

*Attest:*

HARRY F. MANBECK, JR.

*Attesting Officer*

*Commissioner of Patents and Trademarks*